US006526898B1

(12) United States Patent
Ganeshan

(10) Patent No.: US 6,526,898 B1
(45) Date of Patent: Mar. 4, 2003

(54) FURNACE WITH RADIANT REFLECTORS

(75) Inventor: Ram Ganeshan, Sugar Land, TX (US)

(73) Assignee: Technology Sales & Marketing Corporation, Sugar Land, TX (US)

( * ) Notice: Subject to any disclaimer, the term of this patent is extended or adjusted under 35 U.S.C. 154(b) by 0 days.

(21) Appl. No.: 09/683,215

(22) Filed: Dec. 3, 2001

(51) Int. Cl.[7] ..... F23M 9/00; F23M 5/00; F28F 1/20; F22B 23/06; F22B 37/10

(52) U.S. Cl. ..... 110/322; 110/323; 110/326; 110/336; 432/226; 432/210; 165/181; 122/367.3

(58) Field of Search ..... 110/322, 323, 110/324, 325, 326, 336, 337; 432/226, 31, 175, 209, 210; 165/181; 122/367.3; 138/138

(56) References Cited

U.S. PATENT DOCUMENTS 2,670,722 A * 3/1954 Huet ..... 122/367
3,868,823 A * 3/1975 Russell et al. ..... 60/641
4,586,489 A * 5/1986 Voll et al. ..... 126/438
4,721,068 A * 1/1988 Bassols Rheinfelder et al. . 122/367 C
5,109,919 A * 5/1992 Sakuma et al. ..... 165/151
5,437,265 A * 8/1995 Yamauchi et al. ..... 126/657
6,360,700 B1 * 3/2002 Kern ..... 122/511
6,364,658 B1 * 4/2002 Ganeshan ..... 432/209

OTHER PUBLICATIONS

"Evaluation of Radiant Heat Absorption Rates in Tubular Heaters, Petroleum Refiner"; Meklar et al; vol. 31, No. 12, pp. 151–155 (Dec. 1952).

* cited by examiner

*Primary Examiner*—Ira S. Lazarus
*Assistant Examiner*—K. B. Rinehart
(74) *Attorney, Agent, or Firm*—Daniel N. Lundeen; Lundeen & Dickinson, LLP

(57) ABSTRACT

The present invention utilizes radiation reflectors on the refractory wall of a fired furnace opposite the spaces between adjacent tubes. The radiation reflectors focus the reflected radiation from the flame onto the dark side of the tubes. The invention increases the overall heat transfer of the tube by increasing the heat flux rate for the backside of the tube, and also decreases the flux and temperature differentials between the front and rear sides of the tubes.

25 Claims, 6 Drawing Sheets

CASE A (2D SPACING)
AVERAGE FLUX = 10,000 BTU/HR-SQFT

CASE B (3D SPACING)
AVERAGE FLUX = 12,000 BTU/HR-SQFT

FURNACE WITH RADIANT REFLECTORS

BACKGROUND OF INVENTION

The present invention is directed to reflectors used in the radiant section of a fired heater, and more particularly to radiant reflectors provided on a refractory wall centered in the spacing between the radiant tubes.

Combustion equipment is generally operated in chemical plants, petrochemical plants and refineries. The equipment may include industrial heaters, furnaces or plant boilers. This equipment is generally designed with bare or smooth-walled tubes, or with partially studded tubes as disclosed in my earlier U.S. Pat. No. 6,364,658, which is hereby incorporated herein by reference in its entirety. Use of tubes in radiant sections usually exposes the front half of the tube to direct flame radiation, while limiting the exposure of the rear half or dark side of the tube to reflected radiation.

The heat flux distribution around the circumference of a conventionally fired tube at a conventional spacing of two tube diameters is depicted in FIG. 1. A flame or radiating plane is on one side of the tube and a refractory wall is on the other. The front half of the tube surface faces the flame (point A) and receives a higher heat flux as compared to the rear half facing the refractory wall (point B). Point A receives heat flux only from direct flame radiation, while point B, facing the refractory wall, receives only reflected radiation coming from the refractory wall. Points between point A and point B receive varying amounts of both direct and reflected radiation, depending upon their location along the tube.

The standard distance between tubes is two tube diameters from center-to-center, and 1.5 diameters from the center of the tubes to the refractory wall, for most operations in the chemical and petrochemical industries, as shown in FIG. 2. The heat flux distribution in FIG. 1 is based on this configuration. For the purposes of an illustration using fluxes typical in a conventional fired heater, where the highest heat flux at point A is 18000 Btu/hr-ft$^2$, the diametrically opposed counterpart (point B) receives only 6000 Btu/hr-ft$^2$. The rear half of the tube transfers only 24% of the total heat absorbed by the tube; this includes both the direct and reflected radiation, as seen in FIG. 3. The average flux for the tube amounts to 10,000 Btu/hr-ft$^2$.

More than 85% of the heaters in the industry have such a large flux differential between the front and the rear side of the tube, as this illustration depicts. A significant compromise is made on the overall heat-receiving capacity of the tube in order to keep the flame-front side (point A) within safe working temperatures.

To make the heat flux distribution in the tube more uniform, one approach of the furnace designers has been to increase the center-to-center tube spacing requirements from 2 to 3 tube diameters. This design increases the flux at point B of the tube from 6,000 Btu/hr-ft$^2$ to 9,000 Btu/hr-ft$^2$ as shown in FIGS. 4A and 4B. The increased spacing has the beneficial result of increasing the heat-receiving capacity of the rear half of the tube for the 3D-spaced tubes, while heat flux distribution on the front half of the tube is generally the same as for the 2D-spaced tubes. This results in an increase of the average heat flux to 12,000 Btu/hr-ft$^2$ for the entire tube. However, the drawback of this solution is apparent. With an increase in tube spacing there is a corresponding increase in the size of the heater. This increases the cost and space requirements for the heater.

Another prior art approach improves the heat flux distribution by placing radiating flames on opposing sides of the tubes in a so-called "double-fired" design. A comparison is shown between one radiating flame (A) and two radiating flames (B) in FIGS. 5A and 5B, respectively. This design is commonly used in chemical processes that mandate a more uniform heat flux distribution, such as, for example, in delayed cokers, high-pressure hydrotreaters, ethylene furnaces, and the like. In a double-fired system, the front (point A) and rear (point B) portions of the tube have the same heat flux rate due to direct flame radiation, and the points at the margins between the front and rear receive relatively less direct flame radiation. The corresponding distribution of the heat flux, for the illustrative example, is 18,000 Btu/hr-ft$^2$ for the front and the rear locations, 13,500 Btu/hr-ft$^2$ at the margins between the front and rear faces, i.e. the middle area of the tube (point M at the 90 and 270 degree positions), resulting in an average flux of 15,000 Btu/hr-ft$^2$. The double-fired design brings with it the disadvantage that the heater has to be much larger, as much as twice the size as a single-fired unit, and correspondingly more expensive.

The present state of technology for heaters with a standard spacing of 2 tube-diameters will have a relative flux ratio of 1 to 1.8 between the average flux and the maximum flux, whereas a heater with a 3 tube-diameter spacing will have a relative flux ratio of 1 to 1.5, as shown in API Standard 530, *Calculation of Heater-Tube Thickness in Petroleum Refineries*, American Petroleum Institute (1988), Figure C-1 Ratio of Maximum Local to Average Heat Flux Curves, page 103.

The 3 tube-diameter design is less common in the industry and the vessel must be significantly larger than a 2 tube-diameter design. The average to maximum flux ratio of the double-fired tubes is significantly lower at 1 to 1.2, but is a more costly alternative of the three designs for an industrial plant.

A recent improvement in the flux distribution as described in my U.S. Pat. No. 6,364,658, involves the placement of extended surfaces such as studs or fins on the dark side of the tubes in a single-fired arrangement. This improves the heat transfer to the dark side of the tubes primarily by increasing the convection heat transfer. Still, in the standard tube arrangement with smooth walls, it is well known that 65.8% of the radiant heat from the flame is absorbed by the tubes, primarily the front half of the tubes facing the flame, and 34.2% goes through the spaces between the tubes to the refractory wall. The same percentages apply to the reflected radiation from the refractory onto the dark side of the tubes, i.e. 65.8% of the 34.2% is re-radiated to the rear half of the tubes, or 22.5%. In other words, 88.3% is absorbed by the tubes, front and back, and the balance of 11.7% is radiated back to the flame through the spaces between the tubes. It would be very desirable if a significant portion of this 11.7% could be directed onto the tubes instead of the flame. There thus remains a need for making the flux distribution even more uniform and/or for increasing the rate of heat absorption by the tubes.

SUMMARY OF INVENTION

The present invention utilizes radiation reflectors positioned on the refractory wall of a furnace, preferably in the spaces between the radiant tubes. The radiation reflectors provide surfaces which are angled, with respect to generally flat or curvilinear refractory surfaces behind the tubes, to reduce the radiation that is reflected between the tubes and increase the radiation reflected onto the dark side of the tubes. The use of the radiation reflectors thus increases the radiant flux delivered to the dark side of the tubes, increasing heat absorption and decreasing the ratio of the maximum to average flux. The radiation reflectors can also enhance convection heat transfer to the dark side of the tubes by increasing the velocity of the flue gases between the tubes and the refractory wall, thereby increasing the convection heat transfer.

In one aspect, the present invention provides radiation reflectors for use in a fired furnace comprising a plurality of parallel tubes arranged in a row between a flame on a radiant side and a generally flat or curvilinear refractory surface on a dark side. The radiation reflectors have a longitudinal base for abutment against the refractory surface. The base has opposite edges at either side thereof. A longitudinal cusp is opposite the base, and longitudinal reflective surfaces extend from each edge of the base to the cusp. The reflective surfaces have concavity in a plane transverse to a longitudinal axis, preferably parabolic sections in the transverse plane. An anchoring pin can extend transversely through each radiation reflector from the cusp into a subjacent structure.

In another aspect, the invention provides a fired furnace for heating petroleum, petrochemicals or chemicals. The furnace has a plurality of parallel tubes each disposed in a row between a flame on a radiant side thereof and a refractory surface on a dark side thereof. There are spaces between adjacent tubes. Radiation reflectors are positioned on the refractory surface opposite the spaces to reflect incident radiation from the flame away from the spaces and onto the dark side of the tubes. A central longitudinal bore is provided through each tube for the passage therethrough of a fluid to be heated. The row of tubes can be straight or circular. The radiation reflectors can be disposed longitudinally on either side of a flat surface of the refractory surface opposite a tube.

In a further aspect, the invention provides an improvement in a fired furnace. The furnace includes a plurality of parallel tubes disposed between a flame and a refractory wall. Adjacent tubes define a space between the tubes, and each tube includes a central longitudinal bore for the passage therethrough of a fluid to be heated and an outside diameter having a radiant side for exposure to radiation from the flame and a dark side essentially free of direct exposure to the flame. The improvement comprises positioning the radiation reflectors described above on the refractory wall opposite each space. Preferably, the reflective surfaces are parabolic sections in the transverse plane focused on the dark side of the adjacent tubes.

In a still further aspect of the invention, there is provided a method for improving the heat transfer in a fired furnace comprising a plurality of parallel tubes disposed between a flame and a refractory wall. Adjacent tubes define spaces between the tubes. The refractory wall comprises a generally flat or curvilinear surface opposite the tubes and spaces. The method includes the step of installing the radiation reflectors described above on the refractory wall opposite the spaces. The installation can include pinning the radiation reflectors with a pin extending from the cusp into the refractory wall. The radiation reflectors are preferably focused to reflect incident radiation from the flame onto the adjacent tubes on either side of a respective space. The tubes can have extended surfaces at least on the dark side. Where the tubes have smooth outside walls, the method can also include removing the smooth-walled tubes from the furnace and replacing them with tubes that have extended surfaces on a dark side opposite the refractory.

DETAILED DESCRIPTION

Figure 1:
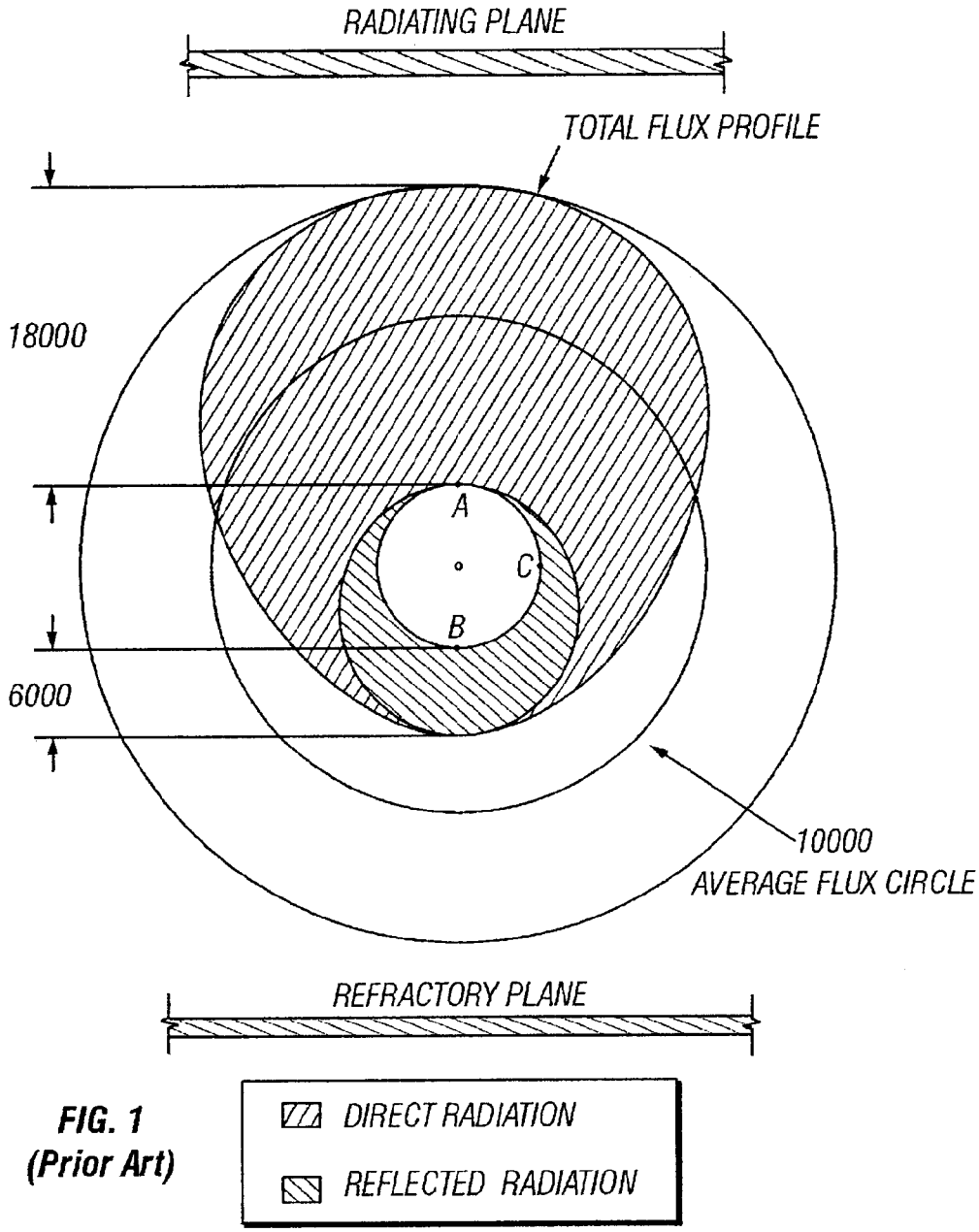
FIG. 1 (Prior Art)
FIG. 1 is a simplified schematic of the heat flux influence on tubing using a single radiating plane with an accompanying refractory wall.
Figure 2:
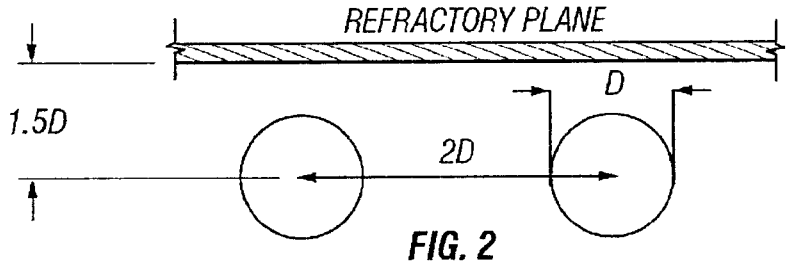
FIG. 2 (Prior Art)
FIG. 2 is a simplified schematic of the standard spacing between tubes.
Figure 3:
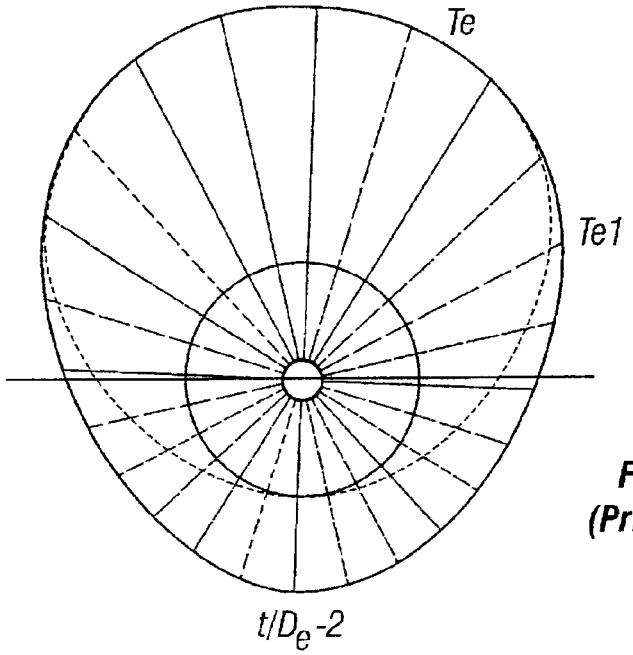
FIG. 3 (Prior Art)
FIG. 3 is a simplified schematic comparing the heat flux received on opposing sides of the tubing.
Figure 4A:
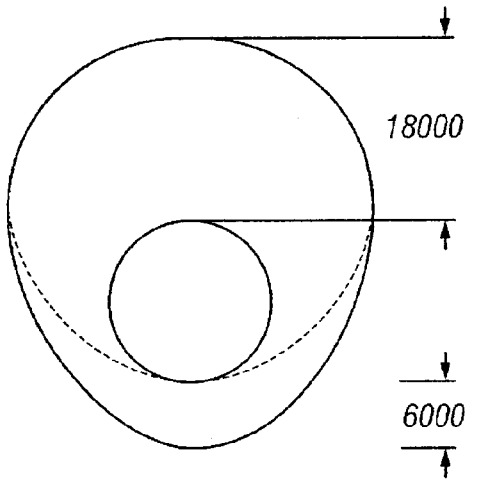
FIG. 4A (Prior Art)
FIG. 4 is a simplified schematic comparing the relative heat flux distribution based on different tube spacing.
Figure 4B:
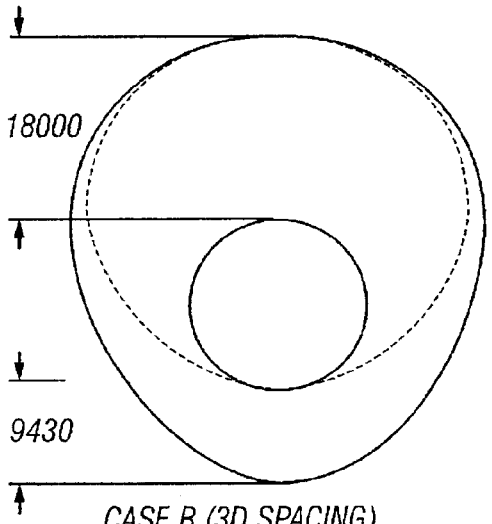
FIG. 4B (Prior Art)
Figure 5A:
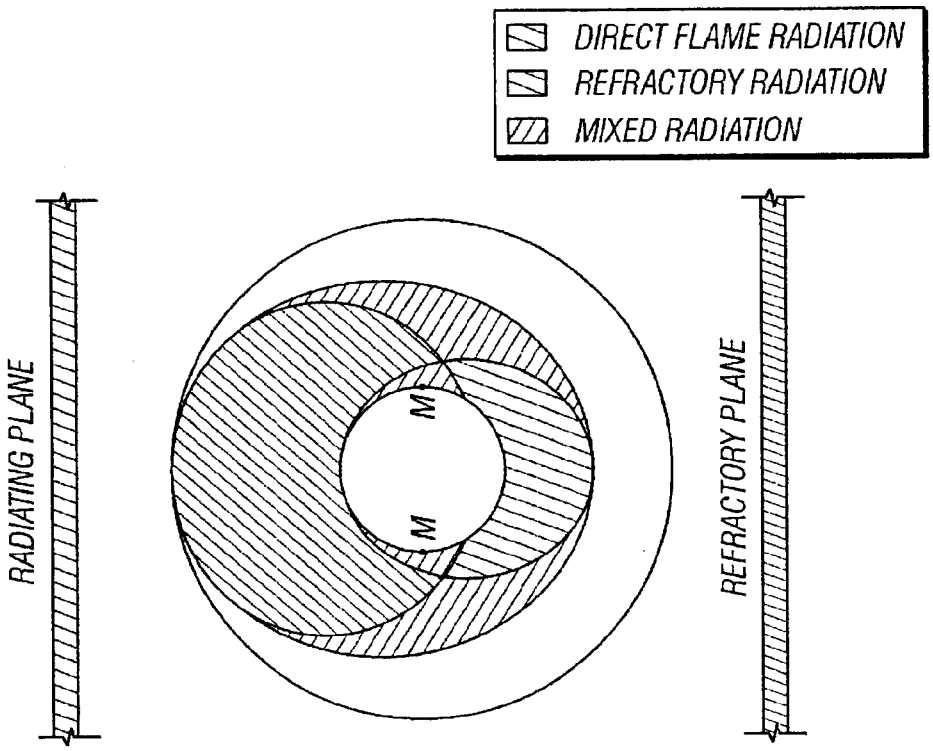
FIG. 5A (Prior Art)
FIGS. 5A and 5B are simplified schematics comparing the heat flux influence on tubing using a single radiant plane (FIG. 5A) to a double radiant plane (FIG. 5B).
Figure 5B:
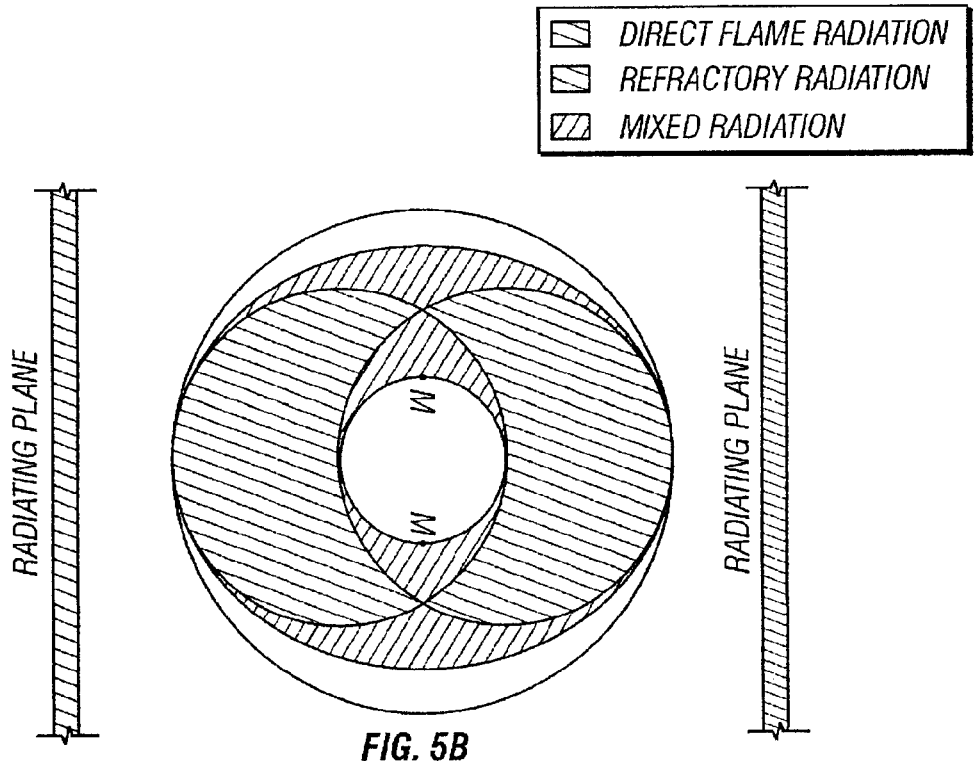
FIG. 5B (Prior Art)
Figure 6:
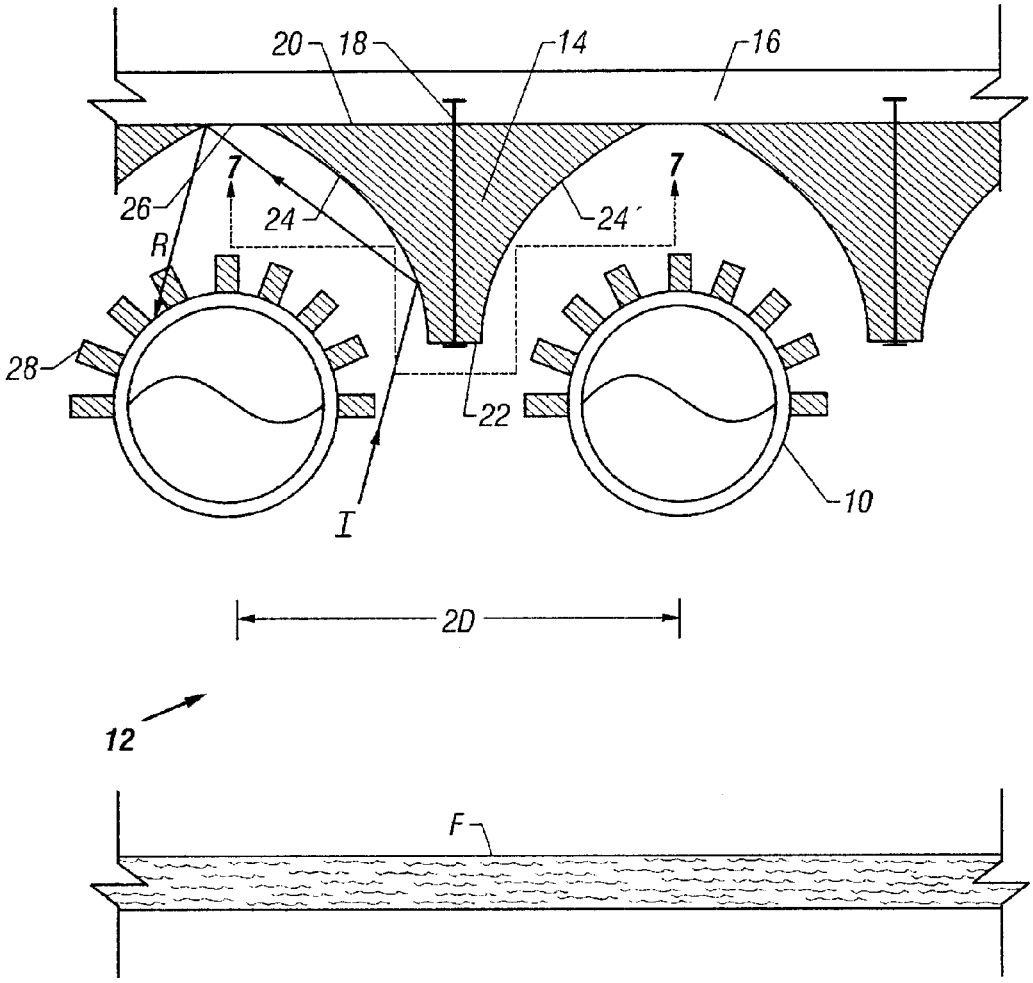
FIG. 6 is a simplified schematic plan of radiation reflectors installed on the refractory wall in the space between the adjacent tubes according to the invention wherein the tubes are arranged in a linear row.
Figure 7:
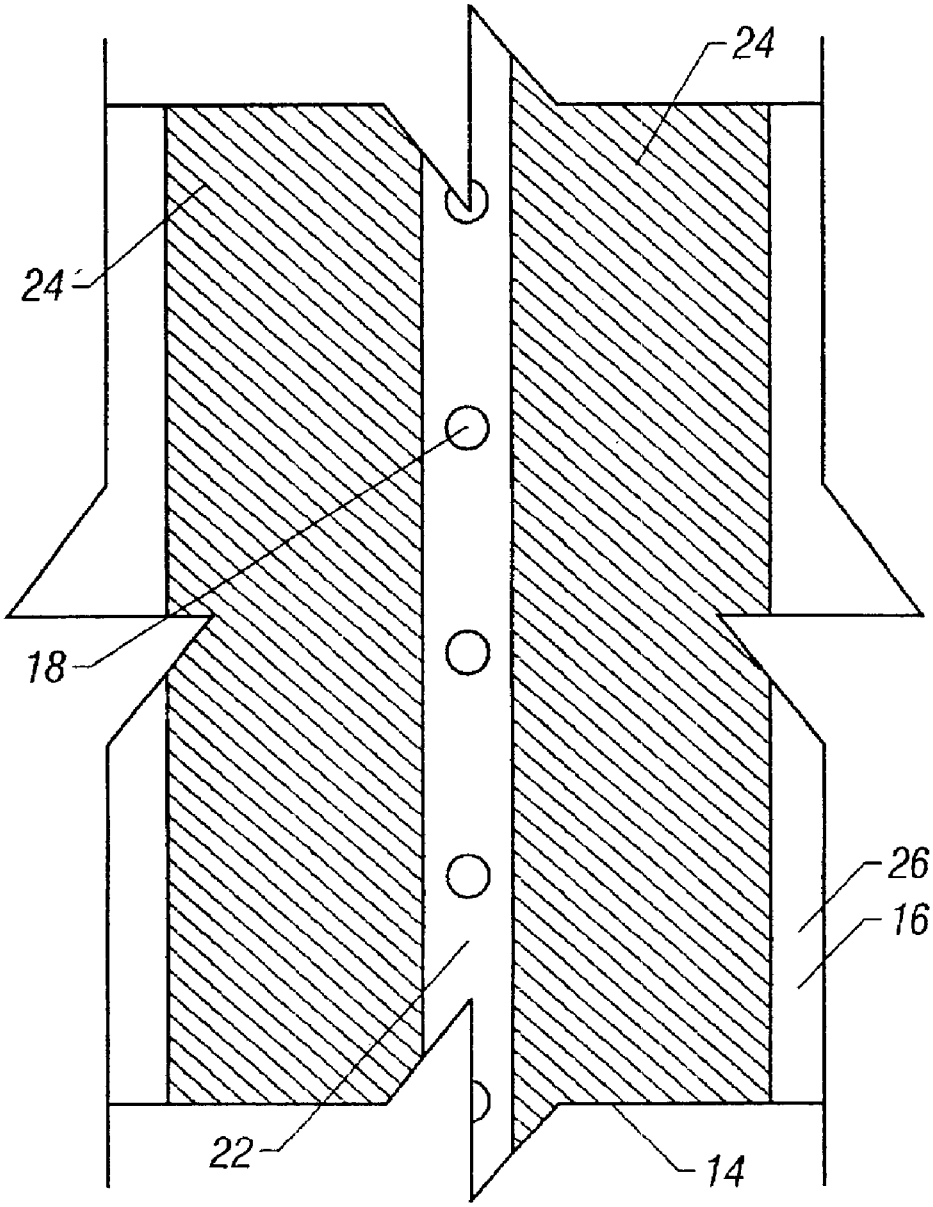
FIG. 7 is a front perspective view of the radiation reflectors of FIG. 6.
Figure 8:
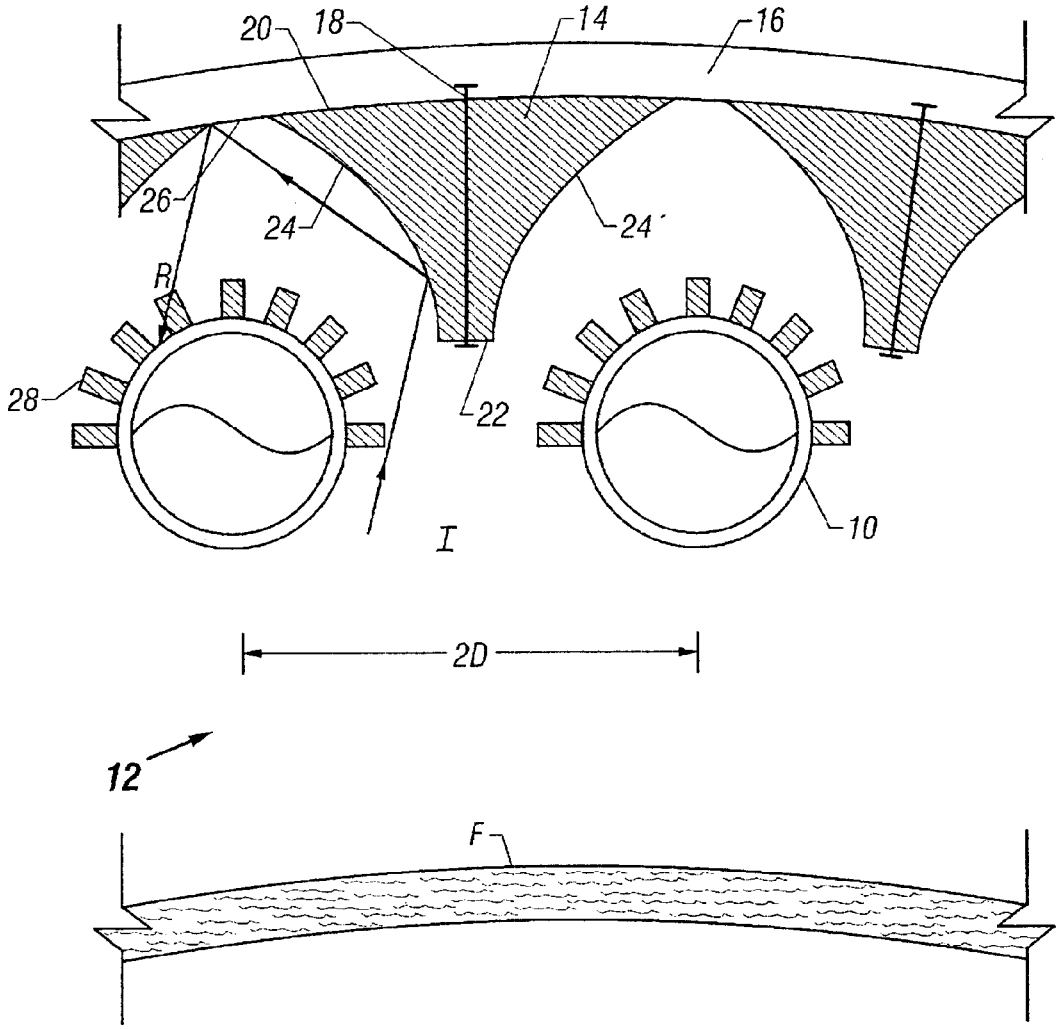
FIG. 8 is a simplified schematic plan of radiation reflectors installed on the refractory wall in the space between the adjacent tubes according to the invention wherein the tubes are arranged in a circular row.

As illustrated in FIGS. 6–8, the present invention enhances the heat transfer rate to the dark side of the tubes 10 in a fired furnace 12 by using radiation reflectors 14 between the tubes 10. The radiation reflectors 14 are secured against the refractory wall 16 by means of a transverse pin 18, for example. The radiation reflectors 14 are made of a conventional cast or shaped refractory material, using conventional casting and/or shaping methodologies and equipment. The radiation reflectors 14 can be prefabricated, or cast or shaped in place (field fabrication). The radiation reflectors 14 can be installed in a new furnace as part of the original design, or can be installed in an existing furnace during scheduled shutdown for other servicing or maintenance or a shutdown for the specific purpose of installing the radiation reflectors 14.

The radiation reflectors 14 are longitudinally oriented and coextensive with the tubes 10 and/or the refractory wall 16, taking the form of corbels in the case of vertically oriented tubes 10. The radiation reflectors 14 are positioned opposite a gap or space between the adjacent tubes 10. The radiation reflectors 14 have a base 20, a cusp 22, and opposing reflecting surfaces 24,24' between either end of the base 20 and the cusp 22. The base 20 desirably has a contour matching that of the refractory wall 16, i.e. it is preferably flat in the case of a flat refractory wall (see FIG. 6), and curved in the case of a curvilinear refractory wall 16 (see FIG. 8), so as to be contiguous with the refractory wall. The cusp 22 is preferably as pointed as possible to maximize reflection away from the spaces, or it can be flattened as necessary to facilitate fabrication and/or pinning of the radiation reflectors 14.

The reflecting surfaces 24,24" preferably have a concave shape as viewed in a transverse plane, for example, a parabolic section. This shape helps the incident radiation I from the flame front F to be reflected at R primarily onto the dark side of the tubes 10, as well as adjacent respective reflecting surfaces 24",24 and/or optional intermediate flats 26 (which can be curvilinear) from which it is subsequently reflected mostly onto the dark side of the tubes 10. Although there will still be minor losses of reflected radiation R through the spaces between the tubes 10, these will be relatively minor compared to the losses in the case of the conventional flat (FIG. 6) or curvilinear refractory wall 16 (FIG. 8) without the radiation reflectors 14. The reflecting surfaces 24,24" thus serve to focus the reflected radiation R onto the dark side of the tubes 10, in that less of the reflected radiation R escapes through the spaces between the tubes 10.

If desired, the tubes 10 can be either horizontal or vertical or sloped between horizontal and vertical. Also, the tubes can be provided with extended surfaces such as studs 28 on the dark side of the tubes 10 as described in my earlier U.S. Pat. No. 6,364,658 mentioned above. For example, for 4-in. OD tubes 10, studs 28 measuring 0.5-in. in diameter and 0.75-in. long can be welded with a broad-based, bell-shaped 100% contact weld attachment at 9 studs per row staggered with 8 studs per row, 19 rows per foot of length. This leaves 3.25-in. between the tip of the closest stud 28 and the opposing flat 26. The combination of studs 28 and radiation reflectors 14 is a preferred embodiment that is particularly effective in increasing the overall heat transfer. The tubes 10 can be arranged in any conventional configuration, such as for example, in a straight row, in which case the refractory wall 16 and the flats 26 are typically planar (see FIG. 6), or in a circular plan, in which case the refractory wall 16 and flats 26 have curvature (see FIG. 8), or the like.

The radiation reflectors 14 serve to enhance the radiation heat transfer to the dark side of the tubes by selectively focusing the reflected radiation R, as described above. For a given maximum flux on the radiant side of the tubes 10, the overall radiation heat transfer is improved and the difference between the radiant and dark side radiant absorption fluxes is thereby reduced with its concomitant advantages of reduced thermal stresses, less bowing of the tubes 10, longer tube life, etc. In addition, the radiation reflectors 14 serve to enhance the convection heat transfer to the dark side of the tubes 10 in two ways. First, by reducing the cross-sectional area available for the flow of flue gases in an open longitudinal channel between the tubes 10 and the refractory wall 16, the velocity of the circulating downdraft gases against the tubes 10 is increased, thereby improving the turbulence and the convective heat transfer coefficient. For example, for 6-in. tubes 10 on a 2D spacing with 1.5D spacing from the refractory wall 16, using corbels having a base 20 of 8-in. and a height of 6-in. from the base to the cusp 22, spaced from the adjacent tubes 10 and not directly attached to them, the radiation reflectors 14 will reduce the free flow area between the tubes 10 and the refractory wall 16 by 26 percent. Second, the convective heat transfer is improved by directing the flow of the circulating downdraft gases onto the dark side of the tubes 10. The improved convective heat transfer further enhances the concomitant advantages of the improved radiant heat transfer mentioned above.

The idea of the radiation reflectors 14 is to prevent all or at least most of the 11.7% re-radiation losses from the refractory walls through the spaces between the tubes 10 that occurs in the conventional flat-walled furnace arrangement. The reflecting surfaces 24,24" in the present invention serve to trap the radiation losses and focus them onto the tubes 10. If the cusp 22 is an ideal pointed design, close to 100% recovery can be achieved, but a practical design to anchor the radiation reflectors 14 may need a flat space for the anchoring pin 18. Even if the efficiency loss is 10% because of the flat space for the pin 18, it can be expected that 90% of the 11.7%, or roughly 10% of the flame radiation will be captured as additional heat by the tubes 10, primarily on the dark side facing the refractory wall and the radiation reflectors 14. Compared to the 22.5% of the flame radiation captured on the dark side of the tubes 10 in a conventional design, this is roughly a 45% increase in the reflected radiant heat impinging on the dark side of the tubes 10.

The invention is described above with reference to specific embodiments solely for the illustration of the invention and not by way of limitation. Various modifications of the specific embodiments will occur to the skilled artisan in view of the above disclosure. All such modifications within the scope and spirit of the appended claims are intended to be embraced thereby.

What is claimed is:

1. A fired furnace, comprising:

a plurality of parallel tubes each disposed in a row between a flame on a radiant side thereof and a refractory surface on a dark side thereof wherein the refractory surface is spaced form the tubes;

refractory radiation reflectors positioned on the refractory surface opposite the spaces to reflect incident radiation from the flame away from the spaces and onto the dark side of the tubes, wherein the refractory radiation reflectors have a base contiguous with the refractory surface and secured to a subjacent structure;

a central longitudinal bore through each tube for the passage therethrough of a fluid to be heated.

2. The furnace of claim 1 wherein the row is straight.

3. The furnace of claim 1 wherein the row is circular.

4. The furnace of claim 1 wherein the radiation reflectors are disposed longitudinally on either side of a flat surface of the refractory surface.

5. The furnace of claim 4 wherein the radiation reflectors comprise a central longitudinal cusp and opposing concave reflective surfaces extending from the cusp to a respective flat surface.

6. The furnace of claim 5 comprising at least one anchoring pin extending transversely through each radiation reflector from the cusp into a subjacent structure.

7. The furnace of claim 5 wherein the concave reflective surfaces comprise parabolic sections focused on the dark side of adjacent tubes.

8. The furnace of claim 1, wherein the tubes have extended surfaces at least on the dark side.

9. The furnace of claim 1 wherein the tubes are on a 2-diameter center-to-center spacing.

10. The furnace of claim 9 wherein the tubes are spaced 1.5 diameters from a center of the tubes to the refractory wall.

11. The furnace of claim 1 wherein the tubes are on a 3-diameter center-to-center spacing.

12. The furnace of claim 1 wherein the refractory radiation reflectors are spaced from the tubes to form an open longitudinal flue gas passage for convection heat transfer.

13. The furnace of claim 1 wherein the refractory radiation reflectors are free from attachment to the radiant and dark sides of the tubes.

14. Refractory radiation reflectors having utility in a fired furnace comprising a plurality of parallel tubes arranged in a row between a flame on a radiant side and a generally flat or curvilinear refractory surface on a dark side, comprising:

a longitudinal base for abutment against the refractory surface, the base having opposite edges at either side thereof;

a longitudinal cusp opposite the base;

longitudinal reflective surfaces extending from each edge of the base to the cusp, the reflective surfaces having concavity in a plane transverse to a longitudinal axis;

wherein the reflective surfaces comprise parabolic sections in the transverse plane.

15. In a fired furnace comprising a plurality of parallel tubes disposed between a flame and a refractory wall, adjacent tubes defining a space between the tubes, each tube including a central longitudinal bore for the passage therethrough of a fluid to be heated and an outside diameter having a radiant side for exposure to radiation from the flame and generally flat or curvilinear refractory surface on a dark side having limited direct exposure to the flame, the improvement comprising:

refractory radiation reflectors positioned on the refractory wall respectively opposite the spaces, wherein the radiation reflectors comprise:

a longitudinal base for abutment against the refractory surface, the base having opposite edges at either side thereof;

a longitudinal cusp opposite the base;

longitudinal reflective surfaces extending from each edge of the base to the cusp, the reflective surfaces having concavity in a plane transverse to a longitudinal axis.

16. The improvement of claim 15 wherein the reflective surfaces comprise parabolic sections in the transverse plane focused on the dark side of the adjacent tubes.

17. The improvement of claim 10 wherein the refractory radiation reflectors are spaced from the tubes to form an open longitudinal flue gas passage for convection heat transfer.

18. The improvement of claim 10 wherein the refractory radiation reflectors are free from attachment to the radiant and dark sides of the tubes.

19. A method for improving the heat transfer in a fired furnace comprising a plurality of parallel tubes disposed between a flame and a refractory wall, adjacent tubes defining spaces between the tubes, the refractory wall comprising a generally flat or curvilinear surface opposite the tubes and spaces, comprising:

installing refractory radiation reflectors on the refractory wall opposite the spaces, wherein the radiation reflectors comprise:

a longitudinal base for abutment against the refractory surface, the base having opposite edges at either side thereof;

a longitudinal cusp opposite the base;

longitudinal reflective surfaces extending from each edge of the base to the cusp, the reflective surfaces having concavity in a plane transverse to a longitudinal axis.

20. The method of claim 19 wherein the installation comprises pinning the radiation reflectors with a pin extending from the cusp into the refractory wall.

21. The method of claim 19 wherein the radiation reflectors are focused to reflect incident radiation from the flame onto the adjacent tubes on either side of a respective space.

22. The method of claim 19 wherein the reflective surfaces comprise parabolic sections in the transverse plane.

23. The method of claim 19 wherein the tubes have smooth outside walls and the method further comprises removing the smooth-walled tubes from the furnace and replacing them with tubes that have extended surfaces on a dark side opposite the refractory.

24. The method of claim 12 comprising spacing the refractory radiation reflectors from the tubes to form an open longitudinal flue gas passage for convection heat transfer.

25. The method of claim 12 wherein the installation of the refractory radiation reflectors is free from attachment thereof to the radiant and dark sides of the tubes.

* * * * *